US010269287B2

(12) United States Patent
Li et al.

(10) Patent No.: US 10,269,287 B2
(45) Date of Patent: Apr. 23, 2019

(54) POWER SAVING METHOD AND DEVICE FOR DISPLAYING CONTENT IN DISPLAY SCREEN

(71) Applicant: Xiaomi Inc., Beijing (CN)

(72) Inventors: Guosheng Li, Beijing (CN); Anyu Liu, Beijing (CN); Shanrong Liu, Beijing (CN)

(73) Assignee: XIAOMI INC., Haidian District, Beijing (CN)

( * ) Notice: Subject to any disclaimer, the term of this patent is extended or adjusted under 35 U.S.C. 154(b) by 127 days.

(21) Appl. No.: 15/231,793

(22) Filed: Aug. 9, 2016

(65) Prior Publication Data

US 2017/0116909 A1 Apr. 27, 2017

(30) Foreign Application Priority Data

Oct. 22, 2015 (CN) ..... 2015 1 0696616

(51) Int. Cl.
*G09G 3/20* (2006.01)
*G09G 3/36* (2006.01)

(52) U.S. Cl.
CPC ..... *G09G 3/2085* (2013.01); *G09G 3/20* (2013.01); *G09G 3/2096* (2013.01); (Continued)

(58) Field of Classification Search
None
See application file for complete search history.

(56) References Cited

U.S. PATENT DOCUMENTS 5,528,256 A * 6/1996 Erhart ..... G09G 3/2011 345/211
9,640,126 B2 * 5/2017 Sun ..... G09G 3/3648
(Continued)

FOREIGN PATENT DOCUMENTS

CN 101394495 A 3/2009
CN 101751873 A 6/2010
(Continued)

OTHER PUBLICATIONS

Office action from KIPO dated Jul. 31, 2017 for KR application 20167015665.
(Continued)

*Primary Examiner* — Joni Richer
(74) *Attorney, Agent, or Firm* — Jun He Law Offices P.C.; James J. Zhu

(57) ABSTRACT

A display method and display device are provided. The method includes: detecting whether a displayed content in a display screen changes; in response to detecting that the displayed content does not change, controlling the display screen to update alternately display data respectively corresponding to odd pixels and even pixels in each row of display unit. The number of updated pixels of the display screen each time may be reduced, while the original refresh frequency is maintained, so the problem that the splash screen phenomena is caused in the display screen by reducing the refresh frequency of the display screen may be solved, thus achieving effects of avoiding the splash screen phenomena of the display screen and of reducing the power consumption of the display screen while maintaining the original refresh frequency of the display screen.

9 Claims, 7 Drawing Sheets

(52) U.S. Cl.
CPC ..... *G09G 3/3611* (2013.01); *G09G 3/3618* (2013.01); *G09G 2310/0213* (2013.01); *G09G 2310/0227* (2013.01); *G09G 2320/02* (2013.01); *G09G 2320/0247* (2013.01); *G09G 2320/103* (2013.01); *G09G 2330/021* (2013.01); *G09G 2340/0435* (2013.01); *G09G 2370/08* (2013.01)

(56) References Cited

U.S. PATENT DOCUMENTS

| | | | | |
|---|---|---|---|---|
| 2007/0296668 | A1* | 12/2007 | Kim | G09G 3/3611 345/89 |
| 2008/0100598 | A1* | 5/2008 | Juenger | G09G 5/36 345/204 |
| 2011/0246801 | A1* | 10/2011 | Seethaler | G06F 1/3218 713/323 |
| 2013/0088479 | A1 | 4/2013 | Kim et al. | |
| 2014/0184583 | A1* | 7/2014 | Wyatt | G09G 3/3614 345/214 |
| 2015/0022512 | A1 | 1/2015 | Ahn et al. | |

FOREIGN PATENT DOCUMENTS

| | | | |
|---|---|---|---|
| CN | 102547310 | A | 7/2012 |
| CN | 104103240 | A | 10/2014 |
| CN | 104299552 | A | 1/2015 |
| EP | 2506240 | A2 | 3/2012 |
| JP | S5854391 | A | 3/1983 |
| JP | 2004012655 | A | 1/2004 |
| JP | 2011028149 | A | 2/2011 |
| KR | 20130039077 | A | 4/2013 |
| RU | 2289887 | C2 | 12/2006 |
| WO | 0065565 | A1 | 2/2000 |

OTHER PUBLICATIONS

Office Action from JPO for JP application 2016529991 and corresponding English translation, dated Nov. 28, 2017
Office Action from RPO for RU application 2016140731/08 and corresponding Search Report, dated Nov. 29, 2017.
Office action from EPO dated Aug. 29, 2016 for European Application No. 16166111.
International search report and written opinion, dated Jun. 20, 2016.

* cited by examiner

POWER SAVING METHOD AND DEVICE FOR DISPLAYING CONTENT IN DISPLAY SCREEN

CROSS REFERENCE TO RELATED APPLICATION

This application is based upon and claims a priority to Chinese Patent Application No. 201510696616.1, filed with the State Intellectual Property Office of P. R. China on Oct. 22, 2015, the entire contents of which are incorporated herein by reference.

TECHNICAL FIELD

The present disclosure relates to the field of image processing technology, and more particularly, to a display method and a display device.

BACKGROUND

Power consumption of a display screen that takes up an important part in the power consumption of a smart device, significantly affects battery lifetime of the smart device. In the related art, reduction of the power consumption of the display screen may be realized by reducing a refresh frequency of the display screen. However, a splash screen phenomenon may be generated if the refresh frequency of the display screen is reduced.

SUMMARY

According to a first aspect of embodiments of the present disclosure, there is provided a display method, including: detecting whether a displayed content in a display screen changes; and controlling the display screen to update alternately display data respectively corresponding to odd pixels and even pixels in each row of display unit, in response to detecting that the displayed content does not change. The display unit being a combination of m rows of pixels divided by row and m being a positive integer.

According to a second aspect of embodiments of the present disclosure, there is provided a device for displaying content, including: a processor; and a memory configured to store an instruction executable by the processor. The processor is configured to: detect whether a displayed content in a display screen changes; and control the display screen to update alternately display data respectively corresponding to odd pixels and even pixels in each row of display unit, in response to detecting that the displayed content does not change. The display unit being a combination of m rows of pixels divided by row and m being a positive integer.

According to a third aspect of embodiments of the present disclosure, there is provided a non-transitory computer-readable storage medium having stored therein instructions that, when executed by a processor of a display device, causes the device to perform a display method, the method including: detecting whether a displayed content in a display screen changes; and controlling the display screen to update alternately display data respectively corresponding to odd pixels and even pixels in each row of display unit, in response to detecting that the displayed content does not change. The display unit being a combination of m rows of pixels divided by row and m being a positive integer.

The technical solutions provided by embodiments of the present disclosure may have following advantageous effects.

By detecting whether the displayed content changes, and controlling the display screen to update alternately the display data respectively corresponding to odd pixels and even pixels in the displayed content if it is detected that the displayed content does not change, the number of updated pixels of the display screen each time may be reduced while the original refresh frequency is maintained, so the problem that the splash screen phenomena may be caused in the display screen by reducing the refresh frequency of the display screen may be solved, thus achieving effects of avoiding the splash screen phenomena of the display screen and of reducing the power consumption of the display screen while maintaining the original refresh frequency of the display screen.

In addition, with three implementations of a terminal for controlling the display screen to update content, the power consumption of the transmission bus is reduced and an effect of reducing electromagnetic interference caused when the display data is transmitted in the transmission bus is achieved.

It is to be understood that both the foregoing general description and the following detailed description are exemplary and explanatory only and are not restrictive of the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the present disclosure. Instead, they are merely examples of apparatuses and methods consistent with aspects related to the present disclosure as recited in the appended claims.

The display method provided by various embodiments of the present disclosure may be realized by an electronic device with a display screen. The electronic device may be a smart phone, a smart television, a panel computer, an electronic book reader, an MP3 (Moving Picture Experts Group Audio Layer III) player, an MP4 (Moving Picture Experts Group Audio Layer IV) player, a laptop portable computer (e.g. a camera, a camcorder), etc. The display screen may be a screen displaying in pixel using an LCD (Liquid Crystal Display), an LED (Light Emitting Diode) or an OLED (Organic Light-Emitting Diode), etc.

Figure 1:
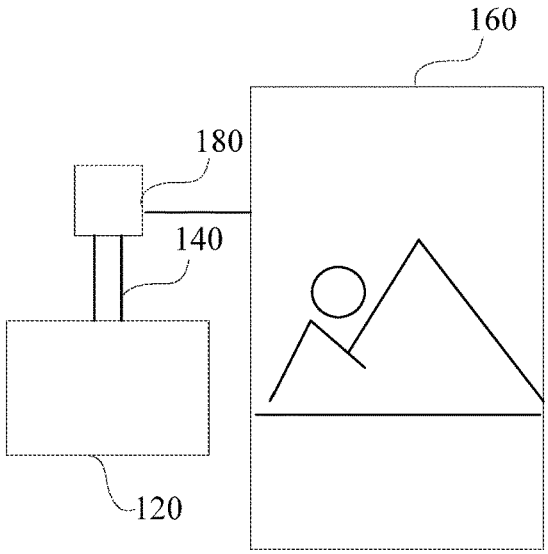
FIG. 1 is a schematic diagram illustrating an implementation environment of a display method according to an exemplary embodiment.

As shown in FIG. 1 that is a schematic diagram illustrating an implementation environment involved in the display method provided by various embodiments of the present disclosure, this implementation environment is an internal environment of the electronic device with the display screen and includes a processor 120, a transmission bus 140, a display screen 160 and a driving integrated circuit 180 corresponding to the display screen 160.

The processor 120 may be a CPU (Central Processing Unit) or a GPU (Graphics Processing Unit) and configured to generate display data corresponding to a displayed content and to transmit the display data to the driving integrated circuit 180 via the transmission bus 140.

The processor 120 and the driving integrated circuit 180 are electrically connected with the transmission bus 140 respectively, and transmit the display data via the transmission bus 140.

The driving integrated circuit 180 is configured to receive the display data sent by the processor 120 via the transmission bus 140, and to control the corresponding pixel unit in the display screen 160 to update the displayed content according to the display data, in which the driving integrated circuit 180 is electrically connected with the display screen 160.

In order to simplify the description, the display method performed by a terminal is taken as example below, but this is not construed as to limit the invention.

Figure 2:
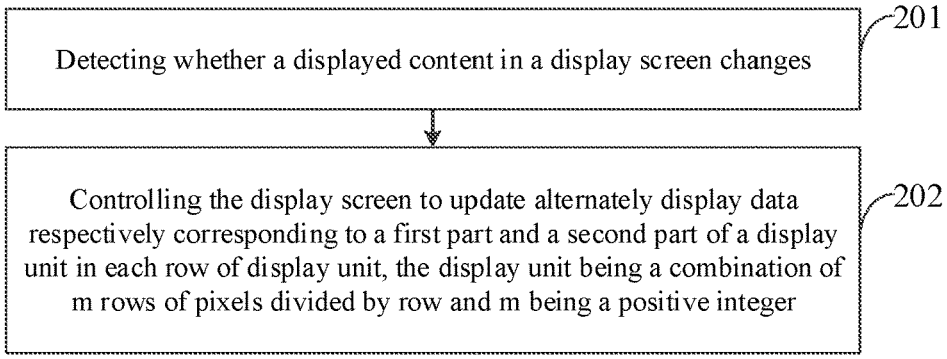
FIG. 2 is a flow chart showing a display method according to an exemplary embodiment.

FIG. 2 is a flow chart showing a display method according to another exemplary embodiment, and the display method is applied in a terminal. As shown in FIG. 2, the display method includes following steps.

In step 201, it is detected whether a displayed content in a display screen changes.

In step 202, the display screen is controlled to update alternately display data respectively corresponding to odd pixels and even pixels in each row of display unit, if the displayed content does not change, in which the display unit is a combination of m rows of pixels divided by row and m is a positive integer.

In conclusion, with the display method provided by embodiments of the present disclosure, by detecting whether the displayed content changes and controlling the display screen to update alternately the display data respectively corresponding to odd pixels and even pixels in each row of display unit if it is detected that the displayed content does not change, the number of updated pixels of the display screen each time may be reduced while the original refresh frequency is maintained, so the problem that the splash screen phenomena may be caused in the display screen by reducing the refresh frequency of the display screen may be solved, thus achieving effects of avoiding the splash screen phenomena of the display screen and of reducing the power consumption of the display screen while maintaining the original refresh frequency of the display screen.

Figure 3A:
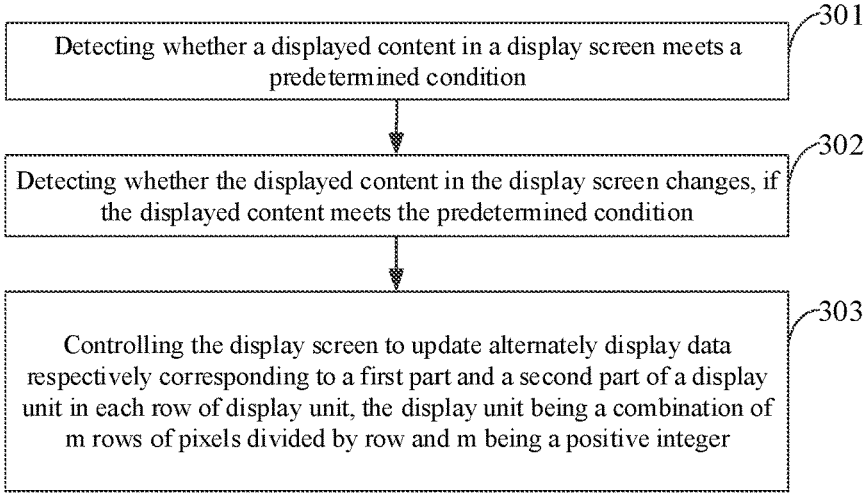
FIG. 3A is a flow chart showing a display method according to an exemplary embodiment.

FIG. 3A is a flow chart showing a display method according to an exemplary embodiment, and as shown in FIG. 3A, the display method includes the following steps.

In step 301, it is detected whether a displayed content in a display screen meets a predetermined condition.

When the display screen in a terminal displays the content, it needs a processor to send display data generated to a driving integrated circuit corresponding to the display screen according to a predetermined frequency. The driving integrated circuit controls the display screen to display the displayed content according to the display data. The processor may be a CPU or a GPU and the predetermined frequency typically may be 60 Hz. However, in certain cases, the displayed content of the display screen may remain unchanged in a short time. For the display screen with a RAM (Random-Access Memory), if the displayed content does not change, the driver integrated circuit may read history display data from the RAM, thereby avoiding a resource waste caused when the processor generates the same display data if the displayed content does not change. However, for the display screen without the RAM, the processor still need to generate the same display data constantly even if the displayed content does not change, resulting in a waste of computational resources of the processor.

In order to avoid the waste of computational resources of the processor caused by generating the same display data, the terminal may detect whether the displayed content meets the predetermined condition in real-time. If it is detected that the displayed content meets the predetermined condition, step 302 is executed. The predetermined condition may include at least one of that the displayed content belongs to a predetermined application or that the number of display frames required by the displayed content is less than a predetermined frame number threshold.

The predetermined application may be a class of applications such as an e-book, a picture viewer. The displayed content corresponding to this class of applications may be a still picture and remain constant over time.

In addition, the predetermined frame number threshold may be a default refresh frequency of the display screen, i.e. the displayed content meets the predetermined condition if the displayed content is a dynamic picture and the frame number is less than the refresh frequency of the display screen, for example, if the displayed content is a video, the display frame number of the video is 24 frames/second, and the refresh frequency of the display screen is 60 Hz (i.e. 60 frame/second), then the displayed content meets the predetermined condition.

In step 302, it is detected whether the displayed content in the display screen changes, if it is detected that the displayed content meets the predetermined condition.

If it is detected that the displayed content meets the predetermined condition, then the terminal detects whether the displayed content to be displayed changes. If the displayed content changes, whole display data corresponding to the displayed content is generated. If the displayed content does not change, step 303 is executed.

As a possible implementation, if the displayed content belongs to the predetermined application and the terminal receives a displayed content changing signal triggered by a user, then the terminal determines that the displayed content changes. The displayed content changing signal may be a signal triggered when the user touches the display screen.

As another possible implementation, if the number of the display frames required by the displayed content is less than the predetermined frame number threshold, then the terminal determines a variation period of the displayed content in accordance with the number of the display frames required by the displayed content and the refresh frequency of the display screen, and detects whether the displayed content changes according to the variation period. For example, the number of the display frames required by the current displayed content is 15 frames/second and the refresh frequency of the display screen is 60 Hz (i.e. 60 frames/second), so the variation period of the displayed content is 4 frames, i.e. the display screen changes the displayed content once while refreshing 4 frames.

In step 303, the display screen is controlled to update alternately display data respectively corresponding to odd pixels and even pixels in each row of display unit if the displayed content does not change, in which the display unit is a combination of m rows of pixels divided by row and m is a positive integer.

The display screen is controlled by the terminal to update alternately the display data respectively corresponding to odd pixels and even pixels in each row of display unit, if the displayed content does not change. Due to the display screen (such as liquid crystal in an LCD) has a certain image holding capability, when the display data corresponding to odd pixels is updated, the displayed content of even pixels will not be disappeared, but will slightly fade, thereby affecting infinitesimally the whole display performance of the displayed content, and not affecting a user experience.

Figure 3B:
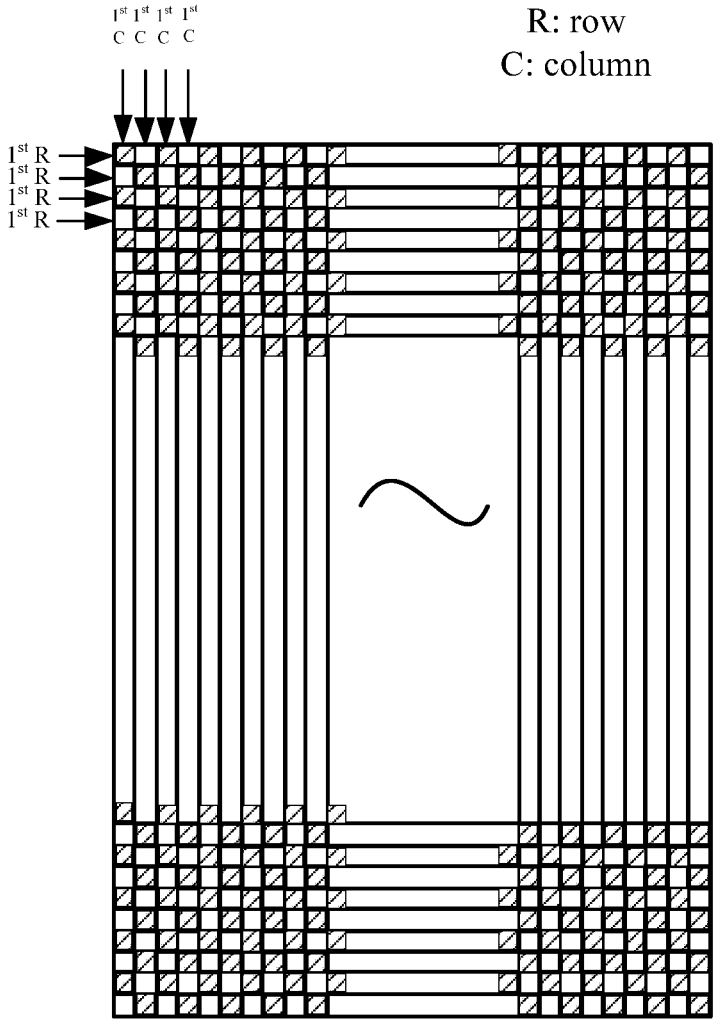
FIG. 3B is a schematic diagram illustrating a first kind of display updating according to an exemplary embodiment.
Figure 3C:
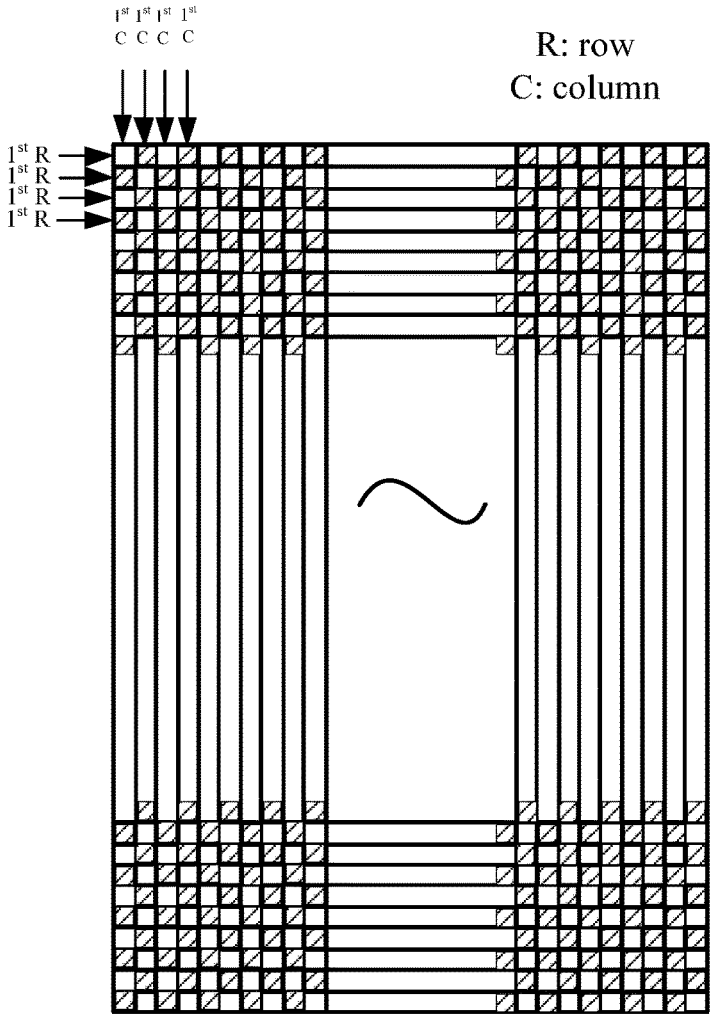
FIG. 3C is a schematic diagram illustrating a second kind of display updating according to an exemplary embodiment.

Referring to FIG. 3B and FIG. 3C, shaded parts are odd pixels and blank parts are even pixels. In this embodiment, in two adjacent columns of the display units, all odd pixels updated in a first row and all odd pixels updated in a second row are staggered in a column direction; and all even pixels updated in the first row and all even pixels updated in the second row are staggered in the column direction. In the above FIG. 3B and FIG. 3C, the shaded parts in the two adjacent rows are staggered in the column direction.

If it is detected that the displayed content does not change, the terminal may control the display screen to update only the display data corresponding to all odd pixels when display updating at an odd number; and to update only the display data corresponding to all even pixels when display updating at an even number. That is, the shaded part in FIG. 3B may be updated during odd display updating; the shaded part in FIG. 3C may be updated during even display updating.

Obviously, the display screen is controlled to display the content by using the above methods. If the displayed content does not change, the display screen no longer needs to update the whole display data at each refreshing and only needs to update a part of the display data at each refreshing, for example, when display updating alternately in accordance with an odd number of pixels and an even number of pixels of the display unit, the updated display data at each time is a half of the original display data, thus reducing significantly the power consumption of the display screen.

There are three possible embodiments as follows for controlling the display screen by the terminal to update the displayed content.

Figure 3D:
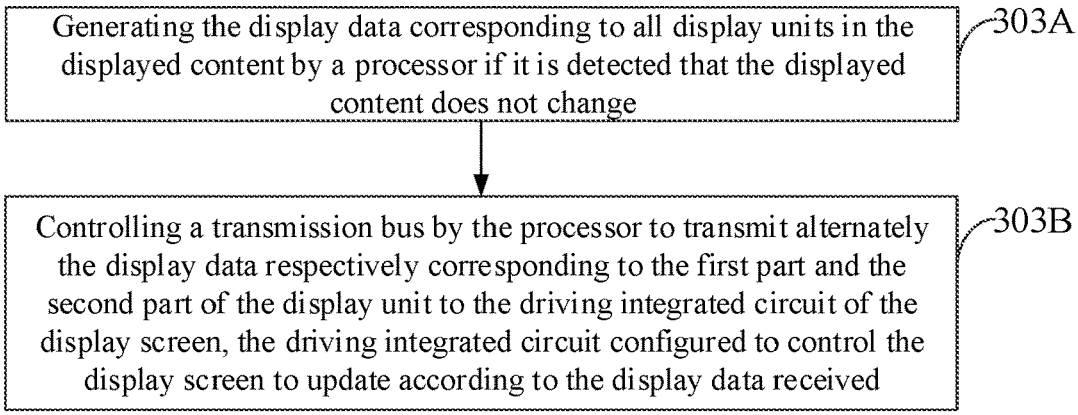
FIG. 3D is a flow chart showing a first kind of display procedure of a display screen involved in a display method according to an exemplary embodiment.

In a first possible embodiment, as shown in FIG. 3D, the above step 303 may include the following steps.

In step 303A, a processor generates the display data corresponding to all display units in the displayed content if it is detected that the displayed content does not change.

If the processor in the terminal detects that the displayed content does not change, i.e., the processor generates the display data corresponding to all display units in the displayed content according to a resolution of the display screen, in which, the processor may be a CPU or a GPU. For example, if the resolution of the display screen is 1080*1920, an amount of the display data corresponding to the displayed content generated by the processor is 1080*1920=2073600 pixels.

In step 303B, the processor controls a transmission bus to transmit alternately the display data respectively corresponding to odd pixels and even pixels to the driving integrated circuit of the display screen, and the driving integrated circuit is configured to control the display screen to update according to the display data received.

To reduce an amount of the display data updated by the display screen when the displayed content does not change, the processor controls the transmission bus to transmit alternately the display data respectively corresponding to odd pixels and even pixels to the driving integrated circuit of the display screen if is the processor detects that the displayed content does not change and the display unit is the combination of m rows of pixels.

After receiving the display data via the transmission bus, the driving integrated circuit controls the corresponding pixels in the display screen to update according to the display data. Since the transmission bus alternately transmits the display data corresponding to an odd number of pixels and an even number of pixels, the display screen updates only the display data corresponding to an odd number of pixels and an even number of pixels when display updating the displayed content at each time. Compared to the conventional display updating method, the transmitting alternately of the display data corresponding to the part of the display unit may have a reduced significantly amount of updated data and no influence on the user perception. In addition, due to a significant decrease on the amount of data transmitted over the transmission bus, the electromagnetic interference caused by data transmitting is reduced accordingly, thereby ensuring a normal operation of other components in the display screen.

It should be noted that, when it is detected that the displayed content changes, the processor sends the whole display data to the driving integrated circuit via the transmission bus, and the driving integrated circuit controls the display screen to update the display data corresponding to all display units in the displayed content.

In this embodiment, when the displayed content does not change and if the display unit is the combination of m rows of pixels, the processor controls the transmission bus to transmit alternately the display data corresponding to odd pixels and even pixels to the driving integrated circuit of the display screen, and the driving integrated circuit is configured to control the display screen to update according to the received display data, thereby reducing the power consumption of the transmission bus and reducing the electromagnetic interference generated when the display data is transmitted over the transmission bus.

Figure 3E:
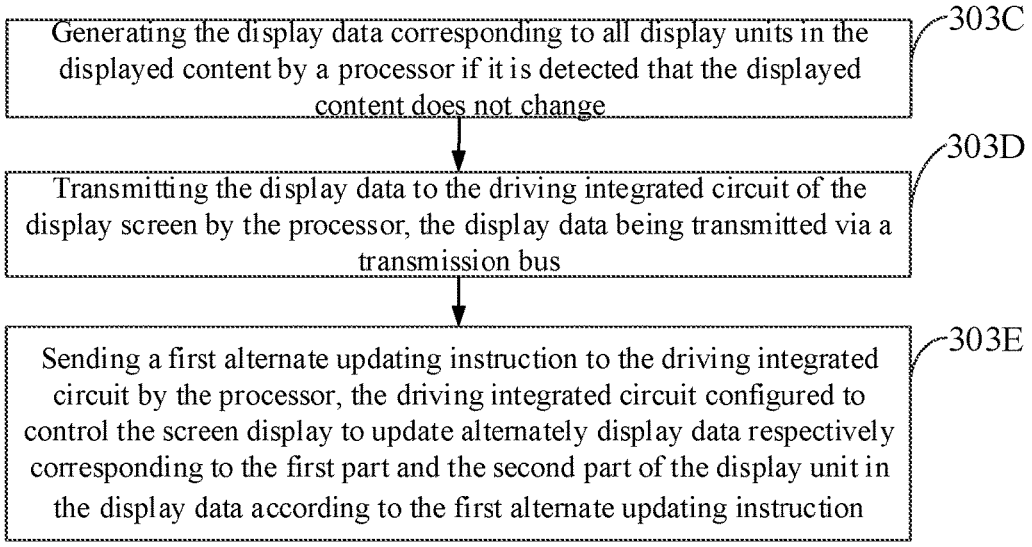
FIG. 3E is a flow chart showing a second kind of display procedure of a display screen involved in a display method according to an exemplary embodiment.

In a second possible embodiment, as shown in FIG. 3E, the above step 303 may include the following steps.

In step 303C, a processor generates the display data corresponding to all display units in the displayed content if it is detected that the displayed content does not change.

The implementation of this step is similar to that of step 303A, which will be not discussed herein.

In step 303D, the processor transmits the display data to the driving integrated circuit of the display screen, and the display data is transmitted via a transmission bus.

Different from the above step 303B, the processor transmits the whole display data to the driving integrated circuit via the transmission bus.

In step 303E, if the display unit is the combination of m rows of pixels, the processor sends a first alternate display updating instruction to the driving integrated circuit, and the driving integrated circuit is configured to control the screen display to update alternately display data respectively corresponding to odd pixels and even pixels according to the first alternate display updating instruction.

The processor sends the alternate display updating instruction to the driving integrated circuit while transmitting the whole display data to the transmission bus. If the display unit is the combination of m rows of pixels, the processor instructs the driving integrated circuit to control the display screen to update alternately the display data respectively corresponding to odd pixels and even pixels in the display data, thereby achieving effects of display updating alternately the display data by the display screen and of reducing the power consumption of the display screen when the displayed content does not change.

It should be noted that, the processor transmits the whole display data to the driving integrated circuit only via the transmission bus, rather than sends the alternate display updating instruction. Correspondingly, the driving integrated circuit controls the displaying screen to update the display data of all display units in the display data.

In this embodiment, when the displayed content does not change, the processor not only sends the display data corresponding to all display units to the driving integrated circuit, but also sends the alternate display updating instruction to the driving integrated circuit, and then instructs the driving integrated circuit to control the display screen to update alternately the display data respectively corresponding to an odd number of pixels and an even number of pixels in the display data, thereby reducing the display updating amount of the display data of the display screen if the displayed content does not change and reducing the power consumption of the display screen.

Figure 3F:
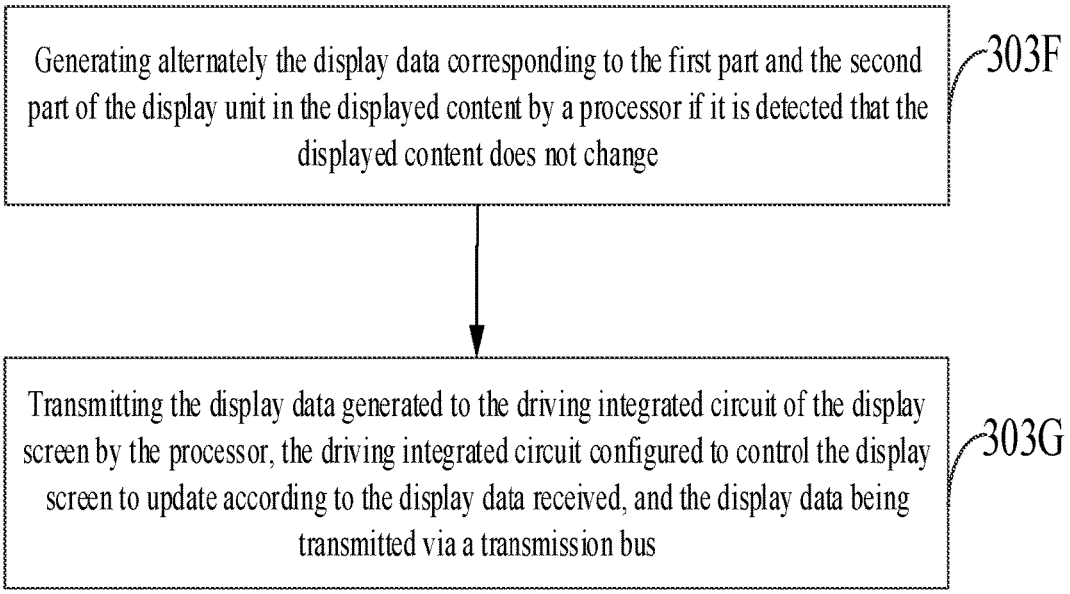
FIG. 3F is a flow chart showing a third kind of display procedure of a display screen involved in a display method according to an exemplary embodiment.

In a third possible embodiment, as shown in FIG. 3F, the above step 303 may include the following steps.

In step 303F, a processor generates alternately the display data corresponding to odd pixels and even pixels in the displayed content if it is detected that the displayed content does not change and the display unit is a combination of m rows of pixels.

Different from the above steps 303A and 303C, the processor generates alternately the display data corresponding to odd pixels and even pixels during the display data generation stage. Compared to generating the whole display data, the processor consumes the significantly reduced processing resources when generating part of the display data, thereby reducing the power consumption of the processor.

In step 303G, the processor transmits the display data generated to the driving integrated circuit of the display screen and the driving integrated circuit is configured to control the display screen to update according to the display data received, and the display data is transmitted via a transmission bus.

The processor generates alternately the display data corresponding to odd pixels and even pixels and transmits the display data generated to the driving integrated circuit via the transmission bus, and the driving integrated circuit control the display screen to update according to the display data received, thereby not only reducing the display updating amount of the display data of the display screen if the displayed content does not change, but also reducing the transmission amount of data over the transmission bus and reducing the electromagnetic interference generated when the display data is transmitted over the transmission bus.

In this embodiment, when the displayed content does not change, the processor may generate alternately the display data corresponding to odd pixels and even pixels and transmits the display data generated to the driving integrated circuit of the display screen via the transmission bus, and the driving integrated circuit controls the display screen to update according to the display data received, thereby not only reducing the amount of the display data generated by the processor, and reducing the power consumption of the processor, but also reducing the power consumption of the transmission bus and reducing the electromagnetic interference generated when the display data is transmitted over the transmission bus.

After obtaining the display data by the above three methods, the driving integrated circuit control the display screen to update the display data. During an implementation, step 303 may further include: if the display unit is the combination of m rows of pixels divided by row, controlling switches of all odd pixels to be in a first state and switches of all even pixels to be in a second state by the driving integrated circuit when display updating at an odd number; and controlling the switches of all even pixels to be in the second state and the switches of all odd pixels to be in the first state by the driving integrated circuit when display updating at an even number.

During the implementation, each pixel is electrically connected with the driving integrated circuit via a corresponding enable line, and is electrically connected with a data line via the switch, in which the driving integrated circuit may control a state of the switch corresponding to the pixel via the enable line. The first state is an on-state and the second state is an off-state, or the first state is the off-state and the second state is the on-state.

For example, when the driving integrated circuit controls the switch of the pixel to be in the on-state via the enable line, the display data of the pixel may be update by transmitting the display data over the data line; when the driving integrated circuit controls the switch of the pixel to be in the off-state via the enable line, the display data of the pixel remains unchanged.

Figure 3G:
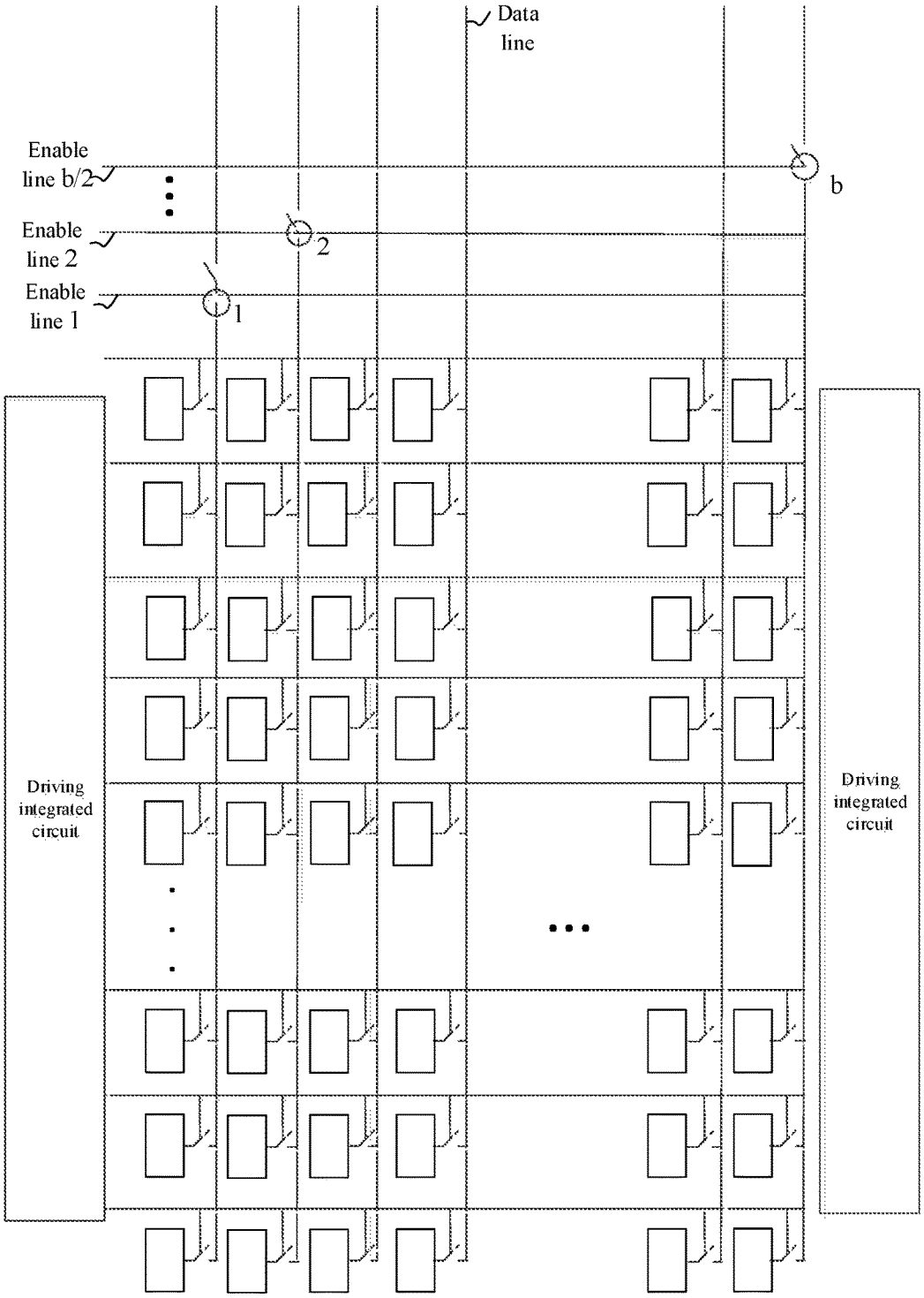
FIG. 3G is a circuit diagram showing a display procedure of a display screen involved in a display method according to an exemplary embodiment.

In this embodiment, one data line can be set for each pixel; also one data line can be set for multiple pixels, which is not limited in the embodiment. Please refer to FIG. 3G, one data line set for the combination of one row of pixels is taken as an example, when scanning the combination of the first row of pixels, i.e. display updating the display data corresponding to the display unit in the first row, an enable line 1 is controlled to control a switch 1 to be on, an enable line 2 is controlled to control a switch 2 to be off, . . . , and so on, an enable line b/2 is controlled to control a switch b to be on; when scanning the combination of the second row of pixels, the enable line 1 is controlled to control the switch 1 to be off, the enable line 2 is controlled to control the switch 2 to be on, . . . , and so on, the enable line b/2 is controlled to control the switch b to be off.

In conclusion, with the display method provided by embodiments of the present disclosure, by detecting whether the displayed content in the display screen changes and controlling the display screen to update alternately the display data respectively corresponding to odd pixels and even pixels in the displayed content if the displayed content does not change, the number of updated pixels of the display screen each time may be reduced while the original refresh frequency is maintained, so the problem that the splash screen phenomena may be caused in the display screen by reducing the refresh frequency of the display screen may be solved, thus achieving effects of avoiding the splash screen phenomena of the display screen and of reducing the power consumption of the display screen while maintaining the original refresh frequency of the display screen.

In addition, with three implementations of a terminal for controlling the display screen to update content, the power consumption of the transmission bus is reduced and an effect of reducing electromagnetic interference caused when the display data is transmitted in the transmission bus is achieved.

Figure 4:
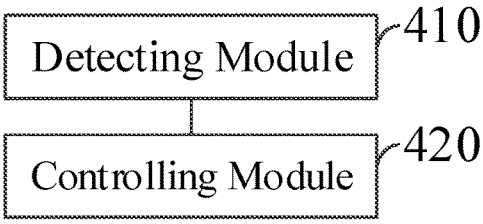
FIG. 4 is a block diagram showing an apparatus for displaying content according to an exemplary embodiment.

FIG. 4 is a block diagram showing an apparatus for displaying content according to an exemplary embodiment. As shown in FIG. 4, the apparatus for displaying content includes a detecting module 410 and a controlling module 420.

The detecting module 410 is configured to detect whether a displayed content in a display screen changes.

The controlling module 420 is configured to control the display screen to update alternately display data respectively corresponding to odd pixels and even number of pixels in each row of display unit, if the detecting module 410 detects that the displayed content does not change, the display unit is a combination of m rows of pixels divided by row and m is a positive integer.

In conclusion, with the apparatus for displaying content provided by embodiments of the present disclosure, by detecting whether the displayed content in the display screen changes and controlling the display screen to update alternately the display data respectively corresponding to odd pixels and even pixels in each row of display unit, if the displayed content does not change, the number of the updated pixels of the display screen each time may be reduced while the original refresh frequency is maintained, so the problem that the splash screen phenomena may be caused in the display screen by reducing the refresh frequency of the display screen may be solved, thus achieving effects of avoiding the splash screen phenomena of the display screen and of reducing the power consumption of the display screen while maintaining the original refresh frequency of the display screen.

Figure 5:
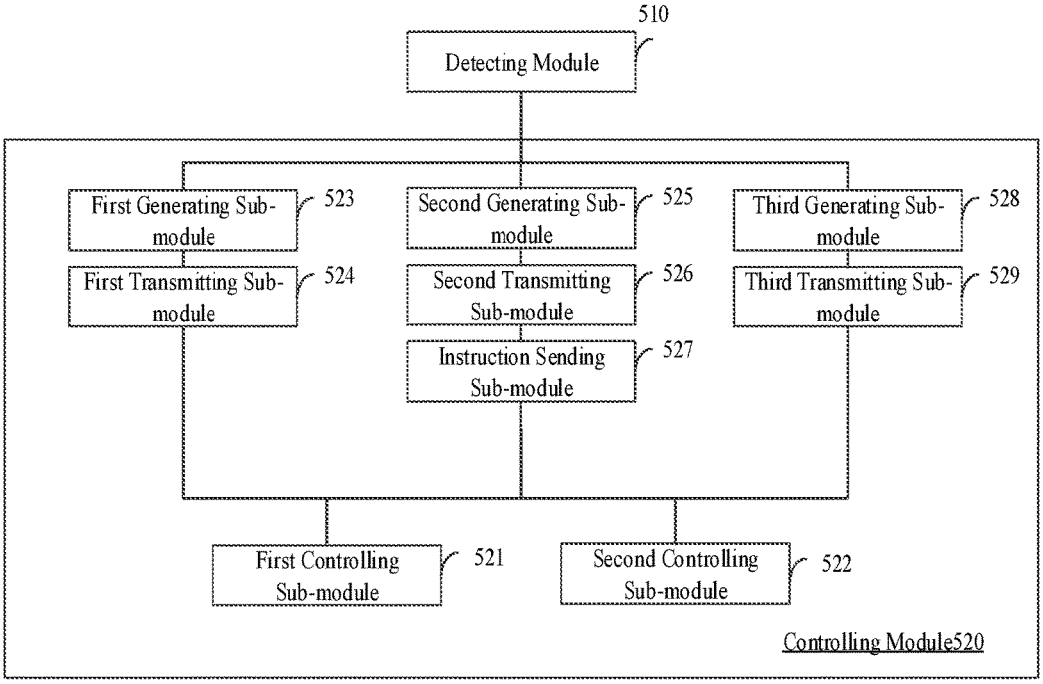
FIG. 5 is a block diagram showing an apparatus for displaying content according to another exemplary embodiment.

FIG. 5 is a block diagram showing an apparatus for displaying content according to an exemplary embodiment. As shown in FIG. 5, the apparatus for displaying the content includes a detecting module 510 and a controlling module 520.

The detecting module 510 is configured to detect whether a displayed content in a display screen changes.

The controlling module 520 is configured to control the display screen to update alternately display data respectively corresponding to odd pixels and even pixels in each row of display unit if the detecting module 510 detects that the displayed content does not change, the display unit is a combination of m rows of pixels divided by row and m is a positive integer.

Alternatively, for two adjacent rows of the display units, all odd pixels updated in a first row and all odd pixels updated in a second row are staggered in a column direction; and all even pixels updated in the first row and all even pixels updated in the second row are staggered in the column direction.

Alternatively, each pixel is electrically connected with a driving integrated circuit via a corresponding enable line, and electrically connected with a data line via a switch, and the controlling module 520 includes a first controlling sub-module 521 and a second controlling sub-module 522.

The first controlling sub-module 521 is configured to control switches of all odd pixels to be in a first state and switches of all even pixels to be in a second state by the driving integrated circuit when display updating at an odd number.

The second controlling sub-module 522 is configured to control the switches of all even pixels to be in the second state and the switches of all odd pixels to be in the first state by the driving integrated circuit when display updating at an even number.

Alternatively, the controlling module further includes a first generating sub-module 523 and a first transmitting sub-module 524.

The first generating sub-module 523 is configured to generate the display data corresponding to all display units in the displayed content by a processor if the detecting module 510 detects that the displayed content does not change.

The first transmitting sub-module 524 is configured to control a transmission bus by the processor to transmit alternately the display data generated by the first generating sub-module 523 and respectively corresponding to odd pixels and even pixels to the driving integrated circuit of the display screen, the driving integrated circuit is configured to control the display screen to update according to the display data received.

Alternatively, the controlling module further includes a second generating sub-module 525, a second transmitting sub-module 526 and an instruction sending sub-module 527.

The second generating sub-module 525 is configured to generate the display data corresponding to all display units in the displayed content by a processor if the detecting module 510 detects that the displayed content does not change.

The second transmitting sub-module 526 is configured to transmit the display data generated by the second generating sub-module 525 to the driving integrated circuit of the display screen by the processor, the display data is transmitted via a transmission bus.

The instruction sending sub-module 527 is configured to send an alternate display updating instruction to the driving integrated circuit by the processor, the driving integrated circuit is configured to control the screen display to update alternately display data respectively corresponding to odd pixels and even pixels in the display data transmitted by the second transmitting sub-module 526 according to the alternate display updating instruction.

Alternatively, the controlling module further includes a third generating sub-module 528 and a third transmitting sub-module 529.

The third generating sub-module 528 is configured to generate alternately the display data corresponding to odd pixels and even pixels in the displayed content by a processor if the detecting module 510 detects that the displayed content does not change.

The third transmitting sub-module 529 is configured to transmit the display data generated by the third generating sub-module 528 to the driving integrated circuit of the display screen by the processor, the driving integrated circuit is configured to control the display screen to update according to the display data received, and the display data is transmitted via a transmission bus.

In conclusion, with the apparatus for displaying content provided by embodiments of the present disclosure, by detecting whether the displayed content changes and controlling the display screen to update alternately the display data respectively corresponding to an odd number of pixels and an even number of pixels in the displayed content if the displayed content does not change, the number of the updated pixels of the display screen each time may be reduced while the original refresh frequency is maintained, so the problem that the splash screen phenomena may be caused in the display screen by reducing the refresh frequency of the display screen may be solved, thus achieving effects of avoiding the splash screen phenomena of the display screen and of reducing the power consumption of the display screen while maintaining the original refresh frequency of the display screen.

In addition, with three implementations of a terminal for controlling the display screen to update content, the power consumption of the transmission bus is reduced and an effect of reducing electromagnetic interference caused when the display data is transmitted in the transmission bus is achieved.

With respect to the devices in the above embodiments, the specific manners for performing operations for individual modules therein have been described in detail in the embodiments regarding the methods, which are not elaborated herein again.

A device for displaying content is provided in embodiments of the present disclosure, which can realize the display method provided in embodiments of the present disclosure. The device for displaying content includes: a processor, a memory configured to store an instruction executable by the processor. The processor is configured to perform the methods described above.

Figure 6:
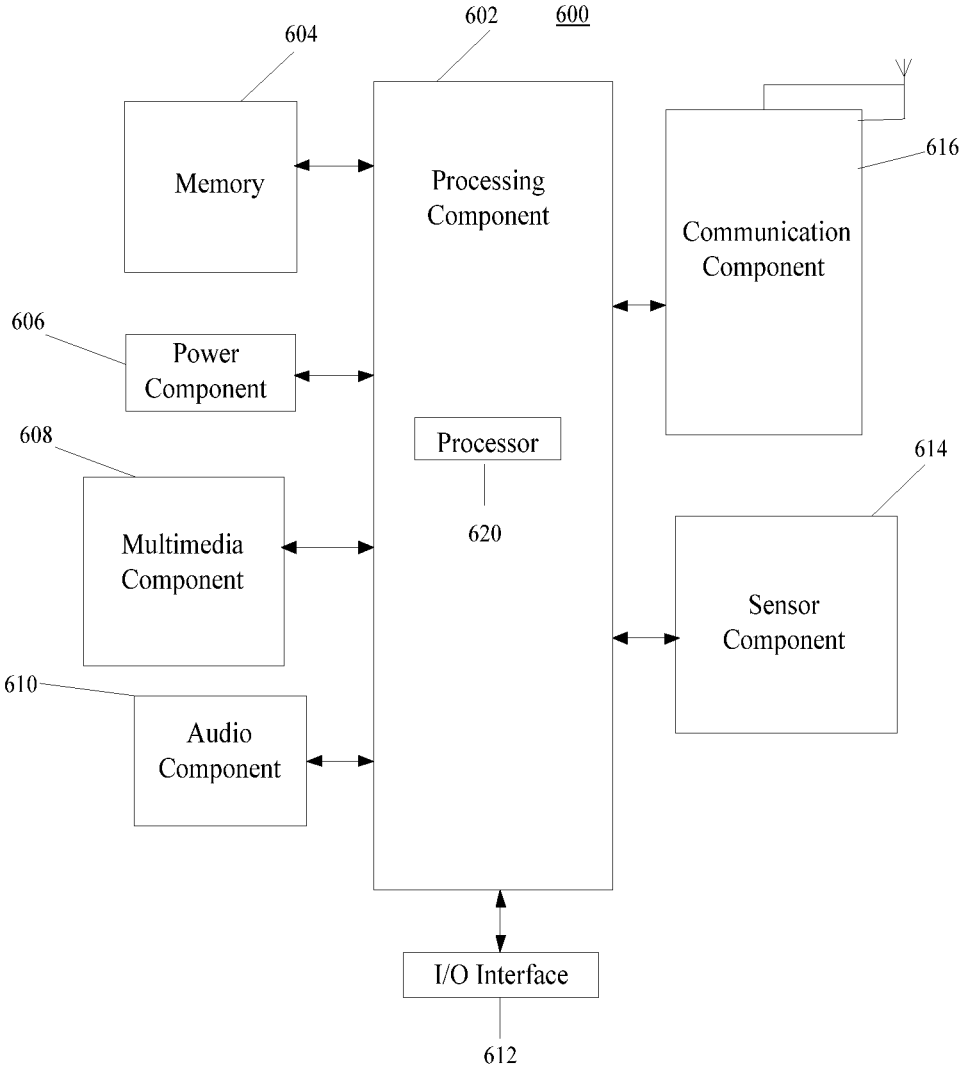
FIG. 6 is a block diagram showing a display device for displaying content according to an exemplary embodiment.

FIG. 6 is a block diagram showing a display device 600 for displaying content according to an exemplary embodiment. For example, the device 600 may be a mobile phone, a computer, a digital broadcast terminal, a messaging device, a gaming console, a tablet, a medical device, exercise equipment, a personal digital assistant, and the like.

Referring to FIG. 6, the device 600 may include one or more of the following components: a processing component 602, a memory 604, a power component 606, a multimedia component 608, an audio component 610, an input/output (I/O) interface 612, a sensor component 614 and a communication component 616.

The processing component 602 typically controls overall operations of the device 600, such as the operations associated with display, telephone calls, data communications, camera operations, and recording operations. The processing component 602 may include one or more processors 620 to execute instructions so as to perform all or a part of the steps in the above described methods. Moreover, the processing component 602 may include one or more modules which facilitate the interaction between the processing component 602 and other components. For instance, the processing component 602 may include a multimedia module to facilitate the interaction between the multimedia component 608 and the processing component 602.

The memory 604 is configured to store various types of data to support the operation of the device 600. Examples of such data include instructions for any applications or methods operated on the device 600, contact data, phonebook data, messages, pictures, videos, etc. The memory 604 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 606 is configured to provide power to various components of the device 600. The power component 606 may include a power management system, one or more power sources, and other components associated with the generation, control, and distribution of power in the device 600.

The multimedia component 608 includes a screen configured to provide an output interface between the device 600 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 608 includes a front camera and/or a rear camera. The front camera and the rear camera may receive an external multimedia datum when the device 600 is in an operation mode such as a photographing mode or a video mode. Each of the front camera and the rear camera may be a fixed optical lens system or have focus and optical zoom capability.

The audio component 610 is configured to output and/or input audio signals. For example, the audio component 610 includes a microphone ("MIC") configured to receive an external audio signal when the device 600 is in an operation mode, such as a call mode, a recording mode, and a voice recognition mode. The received audio signal may be further stored in the memory 604 or transmitted via the communication component 616. In some embodiments, the audio component 610 further includes a loud speaker to output audio signals.

The I/O interface 612 is configured to provide an interface between the processing component 602 and peripheral interface modules, such as a keyboard, a click wheel, buttons, and the like. The buttons may include, but are not limited to, a home button, a volume button, a starting button, and a locking button.

The sensor component 614 includes one or more sensors to provide status assessments of various aspects of the device 600. For instance, the sensor component 614 may detect an on/off status of the device 600, relative positioning of components (e.g., a display screen and a keypad) of the device 600. The sensor component 614 may further detect a change in position of the device 600 or a component of the device 600, a presence or absence of user contact with the device 600, an orientation or an acceleration/deceleration of the device 600, and a change in temperature of the device 600. The sensor component 614 may include a proximity sensor configured to detect the presence of nearby objects without any physical contact. The sensor component 614 may further include a light sensor, such as a CMOS or CCD image sensor, for use in imaging applications. In some embodiments, the sensor component 614 may also include an accelerometer sensor, a gyroscope sensor, a magnetic sensor, a pressure sensor, or a temperature sensor.

The communication component 616 is configured to facilitate a wired or wireless communication between the device 600 and other terminals. The device 600 can access a wireless network based on a communication standard, such as WiFi, 2G, or 3G, or a combination thereof. In one exemplary embodiment, the communication component 616 receives a broadcast signal or broadcast associated information from an external broadcast control system via a broadcast channel. In one exemplary embodiment, the communication component 616 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, or other technologies.

In exemplary embodiments, the device 600 may be implemented with one or more electronic elements such as application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

In exemplary embodiments, there is further provided a non-transitory computer readable storage medium including instructions, such as the memory 604 including instructions executable by the processor 620 in the device 600 to perform the above-described methods. For example, the non-transitory computer-readable storage medium may be a ROM, a RAM, a CD-ROM, a magnetic tape, a floppy disc, an optical data storage device, and the like.

Other embodiments of the present disclosure will be apparent to those skilled in the art from consideration of the specification and practice of the present disclosure disclosed here. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the present disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. A display method, comprising:

detecting whether a displayed content in a display screen is a still picture or a dynamic picture with a frame rate less than a refresh frequency of the display screen;

when the displayed content is a still picture or a dynamic picture with a frame rate less than the refresh frequency of the display screen, detecting whether the displayed content in the display screen changes; and in response to detecting that the displayed content does not change, controlling the display screen to update alternately display data respectively corresponding to odd pixels and even pixels in each row of display unit, the display unit being a combination of m rows of pixels divided by row and m being a positive integer, wherein controlling the display screen to update alternately display data respectively corresponding to odd pixels and even pixels in each row of display unit further comprises:

generating alternately the display data corresponding to odd pixels and even pixels in the displayed content by a processor if it is detected that the displayed content does not change; and transmitting the display data generated to a driving integrated circuit of the display screen by the processor, the driving integrated circuit configured to control the display screen to update according to the display data received, and the display data being transmitted via a transmission bus.

2. The method according to claim 1, wherein for two adjacent rows of the display units, all odd pixels updated in a first row and all odd pixels updated in a second row are staggered in a column direction; and for the two adjacent rows of the display units, all even pixels updated in the first row and all even pixels updated in the second row are staggered in the column direction.

3. The method according to claim 1, wherein each pixel is electrically connected with the driving integrated circuit via a corresponding enable line, and electrically connected with a data line via a switch, and controlling the display screen to update alternately display data respectively corresponding to odd pixels and even pixels in each row of display unit comprises:

controlling switches of all odd pixels to be in a first state and switches of all even pixels to be in a second state by the driving integrated circuit when display updating at an odd number; and controlling the switches of all even pixels to be in the second state and the switches of all odd pixels to be in the first state by the driving integrated circuit when display updating at an even number.

4. A display device for displaying content, comprising:

a processor; and a memory configured to store an instruction executable by the processor;

wherein the processor is configured to:

detect whether a displayed content in a display screen is a still picture or a dynamic picture with a frame rate less than a refresh frequency of the display screen;

when the displayed content is a still picture or a dynamic picture with a frame rate less than the refresh frequency of the display screen, detect whether the displayed content in the display screen changes; and in response to detecting that the displayed content does not change, control the display screen to update alternately display data respectively corresponding to odd pixels and even pixels in each row of display unit, the display unit being a combination of m rows of pixels divided by row and m being a positive integer, wherein the processor is further configured to control the display screen to update alternately display data respectively corresponding to odd pixels and even pixels in each row of display unit by acts of:

generating alternately the display data corresponding to odd pixels and even pixels in the displayed content by a processor if it is detected that the displayed content does not change; and transmitting the display data generated to a driving integrated circuit of the display screen by the processor, the driving integrated circuit configured to control the display screen to update according to the display data received, and the display data being transmitted via a transmission bus.

5. The device according to claim 4, wherein for two adjacent rows of the display units, all odd pixels updated in a first row and all odd pixels updated in a second row are staggered in a column direction; and for the two adjacent rows of the display units, all even pixels updated in the first row and all even pixels updated in the second row are staggered in the column direction.

6. The device according to claim 4, wherein each pixel is electrically connected with the driving integrated circuit via a corresponding enable line, and electrically connected with a data line via a switch, and the processor is configured to control the display screen to update alternately display data respectively corresponding to odd pixels and even pixels in each row of display unit by acts of controlling switches of all odd pixels to be in a first state and switches of all even pixels to be in a second state by the driving integrated circuit when display updating at an odd number; and controlling the switches of all even pixels to be in the second state and the switches of all odd pixels to be in the first state by the driving integrated circuit when display updating at an even number.

7. A non-transitory computer-readable storage medium having stored therein instructions that, when executed by a processor of a display device, causes the device to perform a display method, the method comprising:

detecting whether a displayed content in a display screen is a still picture or a dynamic picture with a frame rate less than a refresh frequency of the display screen;

when the displayed content is a still picture or a dynamic picture with a frame rate less than the refresh frequency of the display screen, detecting whether the displayed content in the display screen changes; and in response to detecting that the displayed content does not change, controlling the display screen to update alternately display data respectively corresponding to odd pixels and even pixels in each row of display unit, the display unit being a combination of m rows of pixels divided by row and m being a positive integer, wherein controlling the display screen to update alternately display data respectively corresponding to odd pixels and even pixels in each row of display unit further comprises:

generating alternately the display data corresponding to odd pixels and even pixels in the displayed content by a processor if it is detected that the displayed content does not change; and transmitting the display data generated to a driving integrated circuit of the display screen by the processor, the driving integrated circuit configured to control the display screen to update according to the display data received, and the display data being transmitted via a transmission bus.

8. The non-transitory computer-readable storage medium according to claim 7, wherein for two adjacent rows of the display units, all odd pixels updated in a first row and all odd pixels updated in a second row are staggered in a column direction; and for the two adjacent rows of the display units, all even pixels updated in the first row and all even pixels updated in the second row are staggered in the column direction.

9. The non-transitory computer-readable storage medium according to claim 7, wherein each pixel is electrically connected with the driving integrated circuit via a corresponding enable line, and electrically connected with a data line via a switch, and controlling the display screen to update alternately display data respectively corresponding to odd pixels and even pixels in each row of display unit comprises:

controlling switches of all odd pixels to be in a first state and switches of all even pixels to be in a second state by the driving integrated circuit when display updating at an odd number; and controlling the switches of all even pixels to be in the second state and the switches of all odd pixels to be in the first state by the driving integrated circuit when display updating at an even number.

* * * * *